US006142161A

United States Patent [19]

Abbruzze

[11] Patent Number: 6,142,161

[45] Date of Patent: Nov. 7, 2000

[54] CLOG RESISTANT PAN ADAPTER

[75] Inventor: Louis S. Abbruzze, Yorba Linda, Calif.

[73] Assignee: EnviroLution, Inc., Glendale, Calif.

[21] Appl. No.: 09/183,762

[22] Filed: Oct. 30, 1998

[51] Int. Cl.[7] ..... B08B 9/00

[52] U.S. Cl. ..... 134/169 A; 123/198 A

[58] Field of Search ..... 134/166 R, 168 R, 134/169 R, 169 A; 123/198 A

[56] References Cited

U.S. PATENT DOCUMENTS

| | | | |
|---|---|---|---|
| 3,431,145 | 3/1969 | Riley . | |
| 3,489,245 | 1/1970 | Broadwell . | |
| 3,797,507 | 3/1974 | Jackson . | |
| 4,951,784 | 8/1990 | Bedi . | |
| 5,048,578 | 9/1991 | Dorf et al. . | |
| 5,063,896 | 11/1991 | Hyatt et al. . | |
| 5,094,201 | 3/1992 | Bedi . | |
| 5,131,421 | 7/1992 | Hofbauer . | |
| 5,168,844 | 12/1992 | Waelput . | |
| 5,190,120 | 3/1993 | Watts | 134/169 A |
| 5,232,513 | 8/1993 | Suratt et al. . | |
| 5,291,863 | 3/1994 | Jones . | |
| 5,452,695 | 9/1995 | Bedi . | |
| 5,467,746 | 11/1995 | Waelput et al. . | |
| 5,474,098 | 12/1995 | Grigorian et al. . | |
| 5,526,782 | 6/1996 | Bedi et al. . | |
| 5,566,781 | 10/1996 | Robert et al. . | |
| 5,711,822 | 1/1998 | Burgett . | |
| 5,791,310 | 8/1998 | Grigorian et al. . | |
| 5,813,382 | 9/1998 | Grigorian et al. . | |

*Primary Examiner*—Frankie L. Stinson
*Attorney, Agent, or Firm*—Fulwider Patton Lee & Utecht, LLP

[57] ABSTRACT

The clog resistant oil pan adapter for an engine flushing system has a main body portion having an interior duct, a tubular connector hub with a primary fluid entry port at the proximal end of the main body portion for connecting with the oil pan drain port, and a distal portion with an annulus with one or more exit ports. One or more secondary fluid entry ports are also formed in the proximal end portion of the tubular connector hub connecting with the interior duct for also receiving flushing fluid from the oil pan interior chamber. The secondary side fluid entry ports can be formed in the proximal end portion of the tubular connector hub and connecting with the primary fluid entry port at the end of the tubular connector hub. Alternatively, the secondary fluid entry ports can be formed in the proximal end portion of the tubular connector hub, and spaced apart from the primary fluid entry port.

11 Claims, 2 Drawing Sheets

FIG. 1
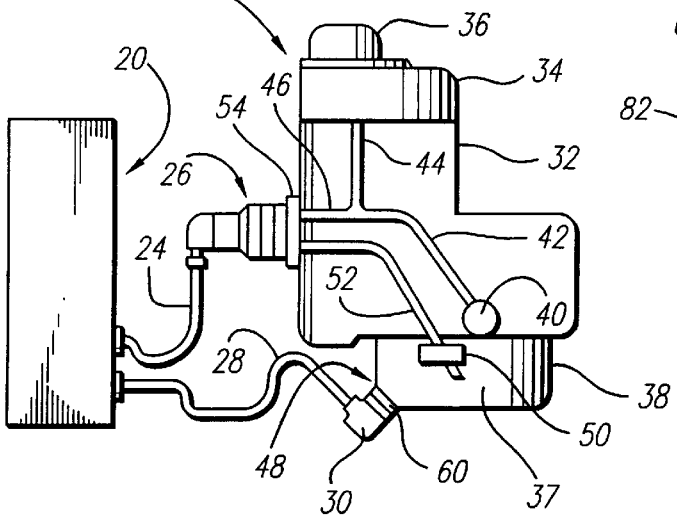
FIG. 3
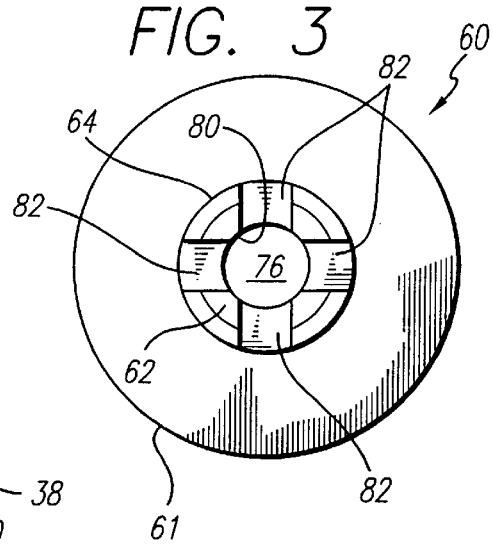
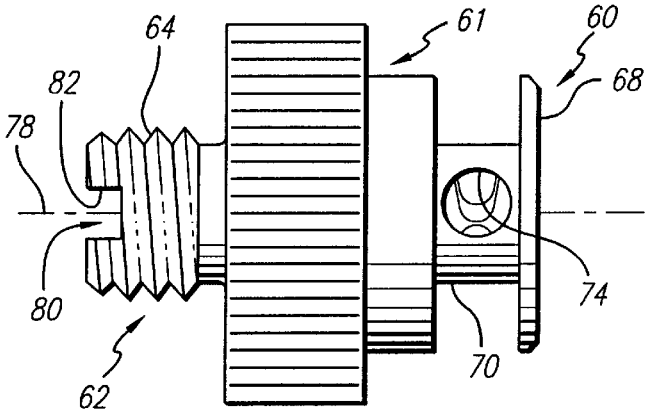
FIG. 2
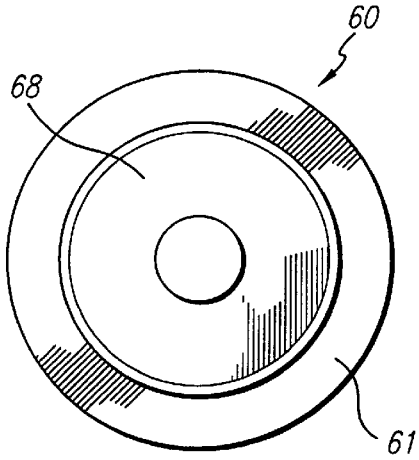
FIG. 4
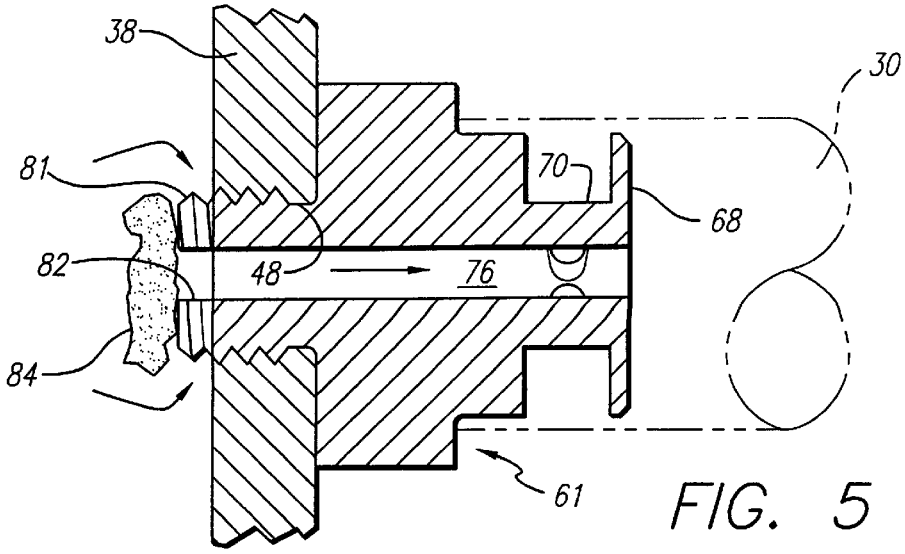
FIG. 5

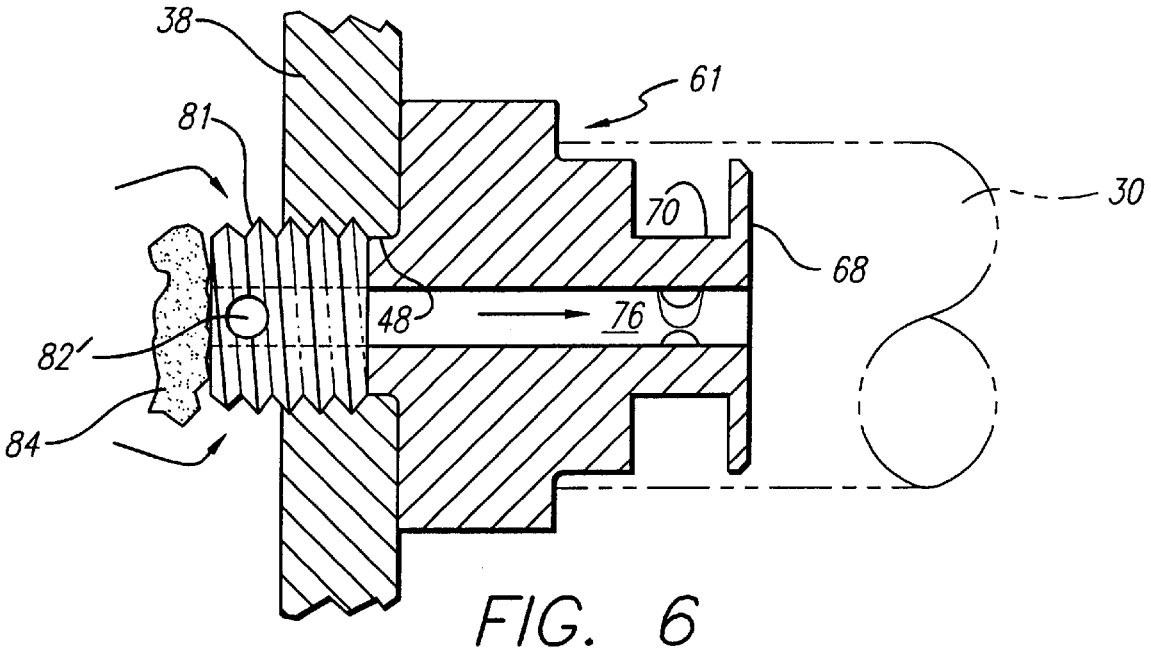
FIG. 6
FIG. 7
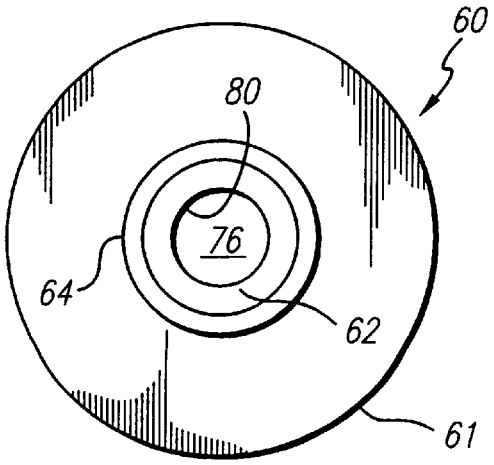

CLOG RESISTANT PAN ADAPTER

BACKGROUND OF THE INVENTION

1. Field of the Invention

This invention relates generally to a lubrication system flushing apparatus for internal combustion engines, and more particularly concerns a clog resistant adapter to be connected to the oil pan drain port of an internal combustion engine for flushing of the engine's lubrication system.

2. Description of Related Art

During operation of the internal combustion engine, oil is taken from the oil pan, where it is typically stored, and circulated throughout the engine to lubricate the internal moving parts. For optimal engine operation and life, and for effective lubrication, the oil must be clean and maintain its lubricating qualities. To keep the oil free of the larger metal particles and dirt that inevitably are created and accumulate in the oil with continued engine use, the oil is typically filtered as it is circulated by a replaceable oil filter carried on the engine. Additionally, to eliminate the more minute particles and acid that builds up in the oil, which the filter cannot remove, the engine oil pan is periodically drained and replenished with new oil, and a new oil filter may be installed.

Even with such periodic maintenance, over time an oily "sludge" is formed within parts of the engine from an accumulation of undissolved tars and insoluble particles, particularly in the oil pan. That sludge degrades engine performance, and can release particles after the oil has been replaced. The presence of those particles in the oil leads to premature engine wear.

To reach and remove accumulated sludge without disassembling the engine, an engine flushing apparatus can be used to treat the engine with a cleaning solution, circulating the cleaning fluid through the engine and oil drain pan from which the engine oil has been drained. A conduit from the flushing apparatus, typically a hose capable of withstanding high fluid pressure, is connected to the oil filter port leading to the engine's lubrication system, and another conduit is connected to the drain port at the engine's oil pan for returning the flushing fluid from the engine's lubrication system to the flushing apparatus. Since the size and type of oil filter port and oil pan drain port differs from automobile manufacturer to manufacturer and even among different models or model year of a single auto manufacturer, the flushing apparatus includes a necessary set of associated adapters to permit connection of the conduits to the respective oil filter and oil pan drain ports of the vast majority of automobile engines.

The flushing fluid is circulated from the apparatus through the oil lubrication system of the engine, where the fluid ideally dissolves the tars of the sludge and collects any undissolved particles in suspension. The flushing fluid exits the engine with dissolved sludge and suspended sludge along with undissolved particles via the oil pan drain port, through which the "dirty" flushing fluid is returned to the flushing apparatus for further processing or disposal.

The flushing apparatus ideally continues circulating the cleaning fluid for a prescribed treatment period. However, it has been found that a fundamental problem interfering with continuing circulation of the flushing fluid for the prescribed treatment period can arise when particulate matter and undissolved, suspended sludge clog the fluid entry port of the adapter connected to the oil pan drain port, requiring interruption of the flushing cycle to remove the clogged adapter from the oil pan drain port to remove the blockage, each time that such blockage occurs. Accordingly, it would be desirable to provide a configuration for an adapter to be connected to the oil pan drain port that can resist blockage during the flushing operation. The present invention meets these needs.

SUMMARY OF THE INVENTION

Briefly, and in general terms, the present invention provides for an improved, clog resistant oil pan drain adapter for a flushing system for cleaning internal combustion engines. The clog resistant adapter has a tubular connecting hub with an interior duct and a primary fluid entry port, and advantageously includes one or more secondary fluid entry ports provided in the tubular connecting hub in fluid communication with the interior duct to allow flushing fluid to flow through the interior duct of the adapter in the event that the primary fluid entry port becomes blocked.

The present invention accordingly provides for a clog resistant oil pan adapter for an engine flushing system for circulating flushing fluid through an internal combustion engine to clean the engine, the engine having an engine block with an oil pan, an oil pan interior chamber, and an oil pan drain port. The clog resistant adapter is adapted to be connected to the oil pan drain port in order to connect the engine flushing system with the oil pan drain port of the engine.

The clog resistant oil pan adapter comprises a main body portion with proximal and distal ends, a tubular connector hub at the proximal end of the main body portion for engaging and mating with the oil pan drain port, an interior duct extending through the main body portion, and a tubular connector hub. The tubular connector hub preferably has external threads to engage and mate with corresponding internal threads in the oil pan drain port, and has a proximal end portion that extends within the oil pan interior chamber when the clog resistant oil pan adapter is connected with the oil pan drain port. In one presently preferred embodiment, the tubular connector hub has a primary fluid entry port and one or more secondary fluid entry ports formed in the proximal end portion of the tubular connector hub, connected in fluid communication with the interior duct for receiving flushing fluid from the oil pan interior chamber when the clog resistant oil pan adapter is connected with the oil pan drain port.

The main body portion of the clog resistant pan adapter also has one or more exit apertures defined in the distal end of the main body portion in fluid communication with the interior duct of the main body portion, adapted to be connected in fluid communication with the engine flushing system to return the flushing fluid to the engine flushing system. In one presently preferred embodiment, the distal end portion has an annulus, and the one or more fluid exit apertures are formed in the annulus. In one presently preferred aspect of the invention, the annulus has three apertures spaced apart at approximately 120 degree intervals.

In one currently preferred embodiment, the primary fluid entry port is located along the axis of the clog resistant adapter, opening into the interior duct, for receiving flushing fluid carrying sludge and undissolved particulate matter, and the secondary side fluid entry ports are formed in the proximal end portion of the tubular connector hub and connected with the primary fluid entry port. Four transverse secondary side fluid entry ports are preferably formed in the proximal end portion of the tubular connector hub at right angles to each other and to the axis of the clog resistant pan adapter. Alternatively, the secondary fluid entry ports can be formed at a location in the proximal end portion of the tubular connector hub, spaced apart from the primary fluid entry port, such that the secondary side fluid entry ports of the tubular connector hub will extend within and be connected in fluid communication with the oil pan interior chamber when the clog resistant adapter is connected to the oil pan drain port.

These and other aspects and advantages of the invention will become apparent from the following detailed description, and the accompanying drawing, which illustrates by way of example the features of the invention.

BRIEF DESCRIPTION OF THE DRAWINGS

FIG. 1 is a schematic diagram of an engine flushing system, including the flushing apparatus, an engine, and the general placement of the clog resistant pan adapter of the invention;

FIG. 2 is side elevational view of the clog resistant pan adapter according to the principles of the invention;

FIG. 3 is an axial end view of the tubular connecting hub of the clog resistant pan adapter of FIG. 2;

FIG. 4 is an axial end view of the opposing end portion and annulus of the clog resistant pan adapter of FIG. 2;

FIG. 5 is a cross-sectional view of the clog resistant pan adapter of FIG. 2, illustrating the clog resistant operation of the pan adapter of the invention during operation of a flushing system for cleaning an internal combustion engine;

FIG. 6 is a cross-sectional view of an alternate embodiment of the clog resistant pan adapter according to the principles of the invention; and FIG. 7 is an axial end view of the tubular connecting hub of the alternate embodiment of the clog resistant pan adapter of FIG. 6.

DETAILED DESCRIPTION OF THE PREFERRED EMBODIMENTS

In order to remove sludge and particulate matter from an internal combustion engine, an engine flushing apparatus can be used to circulate a flushing fluid through the engine and oil pan from which the engine oil has been drained. However, blockage of the adapter connecting the return line from the oil pan to the oil flushing apparatus can seriously interfere with continuing circulation of the flushing fluid for a prescribed treatment period.

As is illustrated in the drawings, the invention is accordingly embodied in an improved, clog resistant oil pan drain port adapter for use with an engine flushing system for circulating flushing fluid through an internal combustion engine to clean the internal combustion engine. Referring to FIG. 1, an engine flushing apparatus 20 for flushing the internal lubrication system of an internal combustion engine 22 includes a conduit or hose 24 connecting the fluid output from the flushing apparatus to the engine by an oil filter port adapter assembly 26, and a second conduit or hose 28 returning flushing fluid to the flushing apparatus by means of an oil pan drain port adapter assembly 30 that is connected to the oil pan drain port of the engine.

The operating components of the flushing equipment and of the engine are neither illustrated nor described in detail since they are well known, are of a conventional structure and do not form a part of the present invention. However, a conventional flushing apparatus 20 typically contains the flushing fluid, typically a known lightweight oil based cleaning fluid, which is pumped from the flushing apparatus and is outputted through hose 24 to the engine. The returned "dirty" flushing fluid is piped back to the flushing apparatus through hose 28. The flushing apparatus includes appropriate electrical controls, not illustrated, to initiate operation, and an electronic digital computer for controlling the operation of the various controls and the duration of the flushing treatment.

The oil filter port typically includes a first oil passage into the engine block for routing oil from the oil filter port to the crankshaft and other internal engine components and a second oil passage for routing fluid from the oil pan and oil pump to the oil filter port. The flushing apparatus typically delivers a volume of flushing fluid through a first conduit to the oil filter port, and receives used flushing fluid through a second conduit from the oil pan drain port.

Engine 22 includes an engine block 32 which contains a cylinder head 34 and valve cover 36. An oil pan 38 is secured to the lower end of the engine. A crankshaft 40 within the engine block receives oil from passage 42. In like manner, the valves and other components within the engine block including the piston cylinder arrangement receive lubricating oil through a second oil passage 44. Oil is supplied to passages 42 and 44 by passage 46.

The oil pan is provided with an oil pan drain port 48, which has a threaded opening. In normal engine operation, a threaded drain plug, not illustrated, is screwed into place sealing the drain pan and is removed when it is desired to drain used oil from the engine.

An oil pump 50 located within the oil pan interior chamber 37 is connected by a fluid passage 52 to an oil filter port 54. In normal engine operation a conventional oil filter, not illustrated, is connected at this port. Engine oil is pumped by a pump 50 from the oil pan interior chamber 37 via conduit 52 through the filter, exits the filter and flows via conduits 46, 42 and 44 into the engine, allowing the filter to remove particulate material and other impurities that may be contained in the oil before reaching crankshaft 40 and other engine components.

Referring to FIGS. 2–5, invention provides for a clog resistant oil pan drain adapter 60 for a flushing system for cleaning internal combustion engines. The clog resistant adapter has a main body portion 61, and a protruding short tubular end portion or connecting hub 62 at a proximal end of the main body portion. The connecting hub has threads 64 to engage and mate with corresponding threads in the oil pan drain port, as is illustrated in FIG. 5. An O-ring 66 is also preferably disposed on the hub to prevent fluid leakage at the engine oil pan drain port. The adapter has an opposing or distal end portion 68 with an annulus 70 that fits into the oil pan drain port assembly 30, for return of flushing fluid to the flushing apparatus. The annulus preferably has a plurality of apertures 74 extending through the annulus to the interior duct 76 of the interchangeable adapter member that extends through the clog resistant adapter along the axis 78 of the adapter, to permit fluid flow from the adapter to the main adapter member 30. The annulus typically has three apertures spaced apart at approximately 120 degree intervals, although any other number of apertures may also be suitable.

The tubular connecter hub of the clog resistant adapter has a primary fluid entry port 80, which in a currently preferred embodiment is located along the axis 78 of the clog resistant adapter, opening into the interior duct for receiving flushing fluid carrying sludge and undissolved particulate matter. The tubular connector hub preferably is of a sufficient length to provide a proximal end portion 81 that extends beyond the oil pan 38 into the oil pan interior chamber 37 when the clog resistant adapter is connected to the oil pan drain port 48, and the tubular connector hub also advantageously includes one or more secondary side fluid entry ports 82 provided in the tubular connecting hub connected in fluid communication with the interior duct to allow flushing fluid to flow through the interior duct of the adapter and around any blockage 84 of the primary fluid entry port. The secondary side fluid entry ports can be formed, for example, in the proximal end of the proximal end portion by cutting one or more channels in the proximal end across the primary fluid entry port. In one presently preferred embodiment, four transverse secondary side fluid entry ports are formed, such as by cross-cutting, in the end of the tubular hub at right angles to each other and to the primary fluid entry port and connecting with the primary fluid entry port at the end of the tubular hub, as is illustrated in FIGS. 3 and 5.

As is illustrated in FIGS. 6 and 7, in which like reference numerals refer to like elements of FIGS. 1–5 described above, one or more apertures 82' spaced apart from the primary fluid entry port 80 may alternatively or additionally be formed in the proximal end portion 81 of the shaft of the tubular hub, such as by drilling, for example, to connect in fluid communication with the interior duct, at a location in the proximal end portion such that the apertures of the tubular connecting hub will extend within and be in fluid communication with the oil pan interior chamber 37 when the clog resistant adapter is connected to the oil pan drain port 48. The tubular connecting hub 62 is thus preferably of a sufficient length that the apertures 82' will extend within and be in fluid communication with the oil pan interior chamber when the clog resistant adapter is connected to the oil pan drain port. In all other respects, the embodiment of FIGS. 6 and 7 is substantially the same as described with regard to the embodiment of FIGS. 2–5.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A clog resistant oil pan adapter for an engine flushing system for circulating flushing fluid through an internal combustion engine to clean the engine, the engine being of the type having an engine block with an oil pan having an oil pan interior chamber and an oil pan drain port, the clog resistant adapter being adapted to be connected with the oil pan drain port and to connect the engine flushing system with the oil pan drain port of the engine, the clog resistant oil pan adapter comprising:

a main body portion having an interior duct extending therethrough, the main body portion having proximal and distal ends, at least one exit aperture being formed in said distal end of said main body portion in fluid communication with the interior duct of the main body portion, for returning the flushing fluid to the engine flushing system;

a tubular connector hub at the proximal end of the main body portion for engaging and mating with the oil pan drain port, said tubular connector hub having a proximal end portion extending within the oil pan interior chamber when said clog resistant oil pan adapter is connected with the oil pan drain port, and said tubular connector hub having a surface defining a primary fluid entry port in said proximal end portion of the tubular connector hub connected in fluid communication with said interior duct for receiving flushing fluid from the oil pan interior chamber when said clog resistant oil pan adapter is connected with the oil pan drain port; and at least one secondary fluid entry port defined in the surface of said proximal end portion of the tubular connector hub connected in fluid communication with said interior duct for receiving flushing fluid from the oil pan interior chamber when said clog resistant oil pan adapter is connected with the oil pan drain port.

2. The clog resistant oil pan adapter of claim 1, wherein said at least one secondary fluid entry port is formed in the proximal end portion of the tubular connector hub and connecting with the primary fluid entry port at the end of the tubular connector hub.

3. The clog resistant oil pan adapter of claim 1, wherein said at least one secondary fluid entry port comprises a plurality of transverse secondary side fluid entry ports formed in the proximal end portion of the tubular connector hub and connecting with the primary fluid entry port at the end of the tubular connector hub.

4. The clog resistant oil pan adapter of claim 1, wherein said at least one secondary fluid entry port comprises four transverse secondary side fluid entry ports formed in the proximal end portion of the tubular connector hub at right angles to each other and to the primary fluid entry port and connecting with the primary fluid entry port at the end of the tubular connector hub.

5. The clog resistant oil pan adapter of claim 1, wherein said at least one secondary fluid entry port is formed in said proximal end portion of said tubular connector hub, spaced apart from the primary fluid entry port, and intersecting with and in fluid communication with the interior duct, such that said at least one secondary fluid entry port of the tubular connector hub will extend within and be in fluid communication with the oil pan interior chamber when the clog resistant adapter is connected to the oil pan drain port.

6. The clog resistant oil pan adapter of claim 5, wherein said at least one secondary fluid entry port comprises a plurality of apertures.

7. The clog resistant oil pan adapter of claim 1, wherein the clog resistant oil pan adapter has an axis, and the primary fluid entry port is located along the axis of the clog resistant adapter, opening into the interior duct, for receiving flushing fluid carrying sludge and undissolved particulate matter.

8. The clog resistant oil pan adapter of claim 1, wherein said tubular connector hub has external threads to engage and mate with corresponding internal threads in the oil pan drain port.

9. The clog resistant oil pan adapter of claim 1, wherein said distal end of said main body portion has an annulus, and said at least one exit aperture is formed in said annulus.

10. The clog resistant oil pan adapter of claim 9, wherein said annulus has a plurality of aperture extending through the annulus to the interior duct of the adapter.

11. The clog resistant oil pan adapter of claim 10, wherein said annulus has three apertures spaced apart at approximately 120 degree intervals.

* * * * *

UNITED STATES PATENT AND TRADEMARK OFFICE

CERTIFICATE OF CORRECTION

PATENT NO. : 6,142,161
DATED : November 7, 2000
INVENTOR(S) : Louis S. Abbruzze

It is certified that error appears in the above-identified patent and that said Letters Patent is hereby corrected as shown below:

Title page,
Under "U.S. PATENT DOCUMENTS", add the following:
-- 5,667,195 9/1997 McCormick --.

Under "FOREIGN PATENT DOCUMENTS", add the following:
-- 2 578 908 9/1986 France
2 563 628 10/1985 France --.

Signed and Sealed this

Nineteenth Day of February, 2002

*Attest:*

*Attesting Officer*

JAMES E. ROGAN
*Director of the United States Patent and Trademark Office*